US010537497B2

(12) United States Patent
Kiyose

(10) Patent No.: US 10,537,497 B2
(45) Date of Patent: Jan. 21, 2020

(54) IMAGE FORMING APPARATUS

(71) Applicant: KYOCERA Document Solutions Inc., Osaka (JP)

(72) Inventor: Kenji Kiyose, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/939,786

(22) Filed: Mar. 29, 2018

(65) Prior Publication Data

US 2018/0280244 A1 Oct. 4, 2018

(30) Foreign Application Priority Data

Mar. 29, 2017 (JP) ..... 2017-064639

(51) Int. Cl.
*B41J 2/21* (2006.01)
*A61J 7/04* (2006.01)

(52) U.S. Cl.
CPC ..... *A61J 7/04* (2013.01); *B41J 2/2107* (2013.01)

(58) Field of Classification Search
CPC ..... A61J 2205/30; A61J 7/04; A61J 7/0076; A61J 2205/20; B41F 17/36; B41J 3/407; B41J 2/2107
See application file for complete search history.

(56) References Cited

U.S. PATENT DOCUMENTS

2002/0174800 A1* 11/2002 Moreland ..... C09D 11/38 106/31.02
2003/0005853 A1* 1/2003 Leu ..... C09D 11/38 106/31.02
2003/0094117 A1* 5/2003 Sir ..... C09D 11/38 106/31.02
2004/0166063 A1* 8/2004 Siegel ..... A61J 1/00 424/10.1
2004/0194659 A1* 10/2004 Taguchi ..... C09D 11/328 106/31.27
2015/0138289 A1* 5/2015 Iijima ..... B41J 11/002 347/102
2015/0352009 A1* 12/2015 Miller ..... B65B 5/08 206/534

FOREIGN PATENT DOCUMENTS

JP 2013-179968 A 9/2013

* cited by examiner

*Primary Examiner* — Scott A Richmond
(74) *Attorney, Agent, or Firm* — Studebaker & Brackett PC

(57) ABSTRACT

An inkjet recording device includes an image forming section and a controller. The image forming section includes a recording head, and forms an image on a package of medication. The controller includes a first determining section and an applying section. The first determining section determines a scent indicating a person taking medication. The applying section applies the scent determined by the first determining section to the package of the medication.

3 Claims, 7 Drawing Sheets

IMAGE FORMING APPARATUS

INCORPORATION BY REFERENCE

The present application claims priority under 35 U.S.C. § 119 to Japanese Patent Application No. 2017-064639, filed on Mar. 29, 2017. The contents of this application are incorporated herein by reference in their entirety.

BACKGROUND

The present disclosure relates to an image forming apparatus.

A "medication reminder board" includes a base plate, a calendar section, and a sealed container. The calendar section includes an empty calendar formed on the base plate. The base plate is formed of a steel sheet. The empty calendar is a table that displays days of the week but not dates. The sealed container includes a plurality of date display sections on a surface thereof. Numbers from 1 to 31 are recorded one by one in the date display sections. The sealed container houses medication. The reverse side of the sealed container includes a magnet. The sealed container is attached to the calendar section such that the numbers of the date display sections correspond to an actual calendar.

SUMMARY

An image forming apparatus according to the present disclosure includes a first determining section and an applying section. The first determining section determines a scent indicating a person taking medication. The applying section applies the scent determined by the first determining section to a package of the medication.

DETAILED DESCRIPTION

Figure 1:
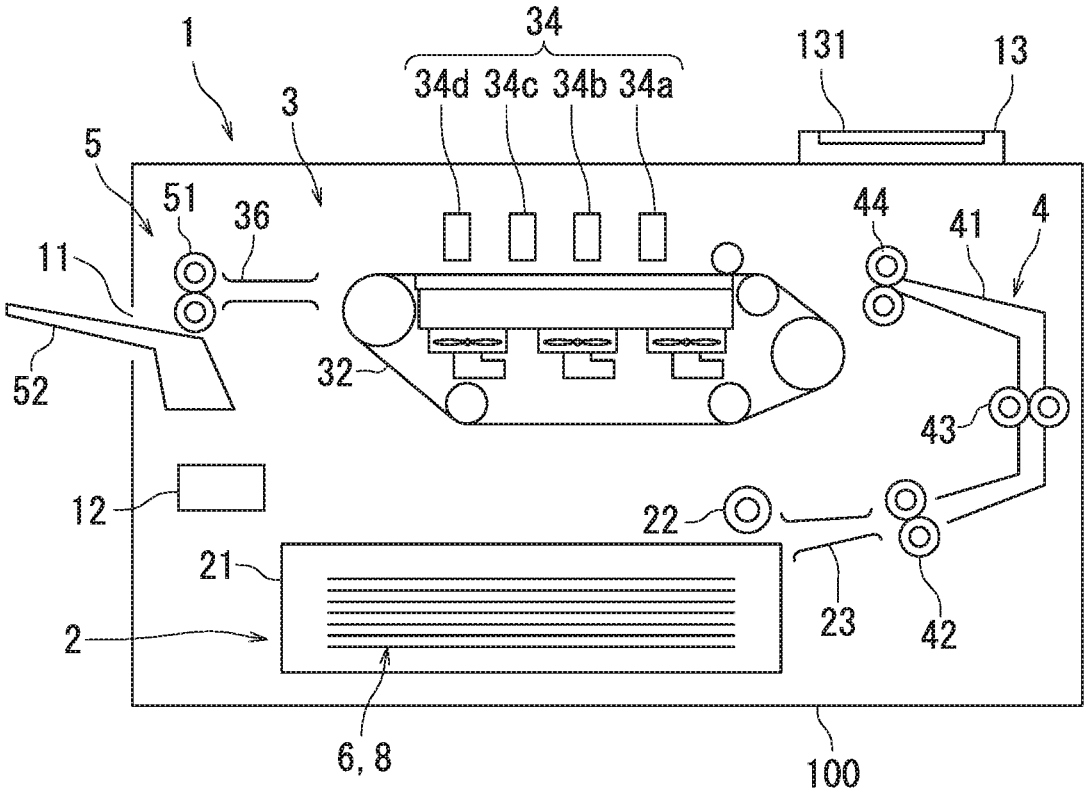
FIG. 1 is a diagram illustrating a configuration of an inkjet recording device according to an embodiment of the present disclosure.

An embodiment of the present disclosure will be described as follows with reference to the drawings (FIGS. 1 to 7). It should be noted that elements in the drawings that are the same or equivalent are labelled using the same reference signs and description thereof is not repeated.

First, an inkjet recording device 1 according to the present embodiment will be described with reference to FIG. 1. FIG. 1 is a diagram illustrating a configuration of the inkjet recording device 1 according to the present embodiment. The inkjet recording device 1 includes a device casing 100, a feeding section 2, an image forming section 3, a paper conveyance section 4, an ejection section 5, a controller 12, and an operation display section 13. The inkjet recording device 1 is equivalent to an example of an "image forming apparatus".

The feeding section 2 is located within a lower portion of the device casing 100. The feeding section 2 includes a paper feed cassette 21, a sheet feed roller 22, and a guide plate 23. The paper feed cassette 21 houses a medication package 6 or paper 8 and is freely attachable to and detachable from the device casing 100. The feeding section 2 feeds the medication package 6 (or the paper 8) to the paper conveyance section 4.

The paper conveyance section 4 is located on a side (the right side in FIG. 1) of the image forming section 3. The paper conveyance section 4 includes a paper conveyance path 41, a first conveyance roller pair 42, a second conveyance roller pair 43, and a registration roller pair 44. The paper conveyance section 4 sends the medication package 6 (or the paper 8) to the image forming section 3 in accordance with the timing of image formation.

The image forming section 3 is located above the feeding section 2. The image forming section 3 includes a conveyor belt 32, recording heads 34 (four types of recording head: 34*a*, 34*b*, 34*c*, and 34*d*), and a conveyance guide 36. The image forming section 3 forms an image on the medication package 6 or the paper 8.

A cyan ink Kc is housed in the recording head 34*a*. A magenta ink Km is housed in the recording head 34*b*. A yellow ink Ky is housed in the recording head 34*c*. A black ink Kk is housed in the recording head 34*d*.

Each of the inks Kc, Km, Ky, and Kk include an aromatic component. The aromatic components included in each of the inks Kc to Kk differ from each other. The aromatic components include: natural perfumes such as ambergris, benzoin, clove oil, jasmine absolute, mimosa, and violet leaf absolute; and synthetic perfumes such as higher alcohol, aldehyde, benzaldehyde, benzoic acid, cinnamic acid, coumarin, ester, and ketone.

Since the aromatic components included in the respective inks Kc to Kk differ from each other, images of different colors have different scents when the images are formed on the medication package 6 (or the paper 8). Thus, various scented images can be formed on the medication package 6 (or the paper 8). A darker image has stronger scent among images of the same color.

The ejection section 5 is located on another side (the left side in FIG. 1) of the image forming section 3. The ejection section 5 includes an ejection roller pair 51 and an exit tray 52. The ejection section 5 ejects the medication package 6 or the paper 8 out of the device casing 100 through the exit port 11.

The controller 12 includes a processor and storage. The processor includes a central processing unit (CPU), for example. The storage includes memory such as semi-conductor memory, and may also include a hard disk drive (HDD). The storage stores a control program.

The operation display section 13 includes a touch panel 131. The touch panel 131 includes a liquid crystal display (LCD), for example, and displays various images. The touch panel 131 also includes a touch sensor and receives operations from a user.

Figure 2:
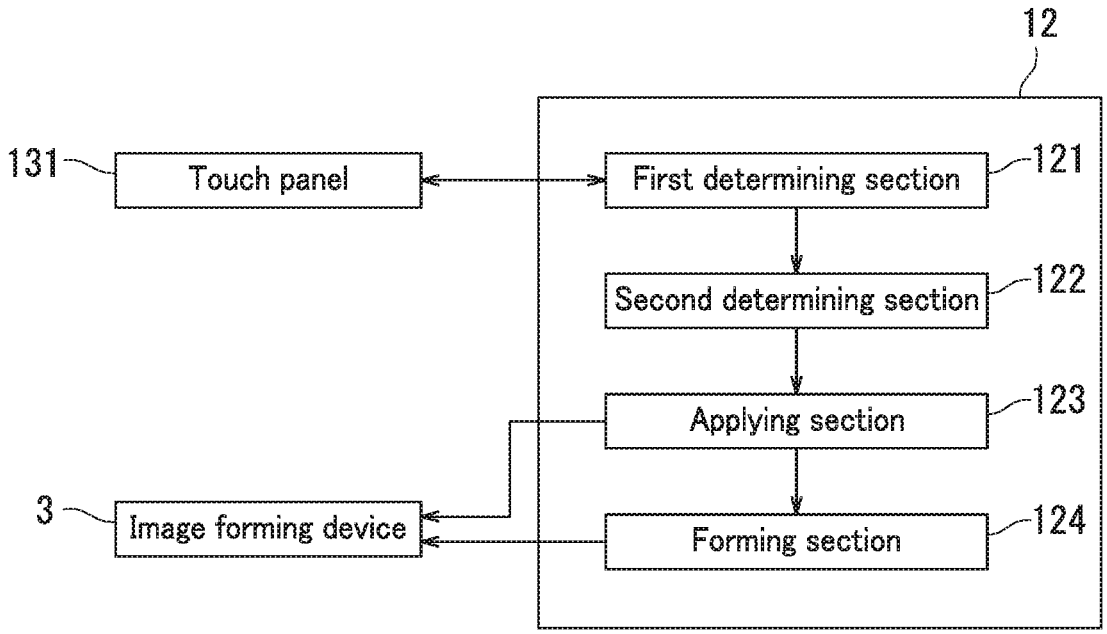
FIG. 2 is a diagram illustrating a configuration of a controller.

Next, a configuration of the controller 12 will be described with reference to FIGS. 1 and 2. FIG. 2 is a diagram illustrating the configuration of the controller 12. As illustrated in FIG. 2, the controller 12 includes a first determining section 121, a second determining section 122, an applying section 123, and a forming section 124. Specifically, the processor of the controller 12 functions as the first determining section 121, the second determining section 122, the applying section 123, and the forming section 124 by executing the control program.

The first determining section 121 determines a scent to indicate a person taking medication, based on an instruction from the user. Specifically, the first determining section 121 determines a scent corresponding to each person taking medication. For example, the first determining section 121 determines a scent desired by a person taking medication from a plurality of selectable scents to indicate the person taking medication.

The first determining section 121 also determines a color (densities of a color, for example) to indicate days of the week on which the medication is to be taken, based on an instruction from the user.

The second determining section 122 determines the strength of the scent based on a period from when the scent is applied to the medication package 6 to the date the medication is to be taken.

The applying section 123 applies the scent determined by the first determining section 121 to the medication package 6.

The forming section 124 forms an image in the color determined by the first determining section 121 on the medication package 6.

As described above with reference to FIGS. 1 and 2, the user can be prevented from mistaking the medication of another person for the medication of the user because a scent indicating the person who takes the medication is applied to the medication package 6.

Components of scents that are different from each other are added to the inks Kc to Kk of the respective colors. The scents are then applied to the medication package 6 by spraying the inks Kc to Kk on to the medication package 6. Accordingly, various scents can be applied by spraying the inks Kc to Kk of the respective colors on to the medication package 6.

Figure 3A:
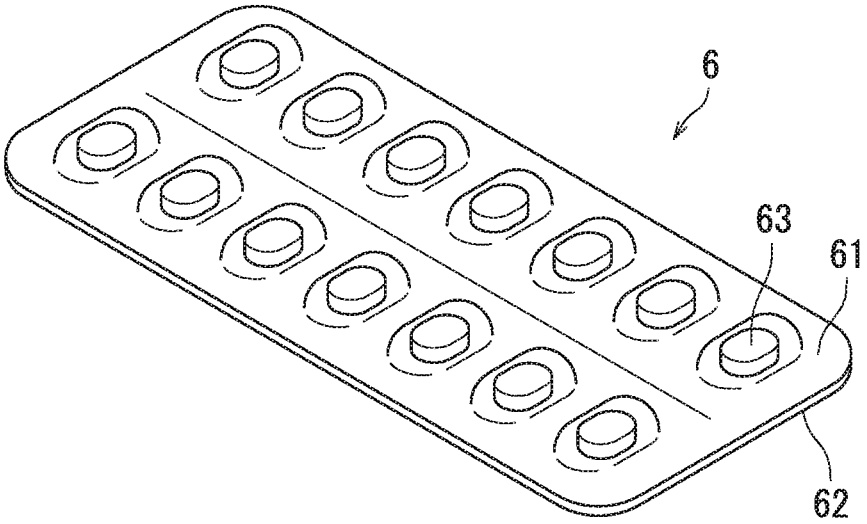
FIG. 3A is a perspective view illustrating a medication package.
Figure 3B:
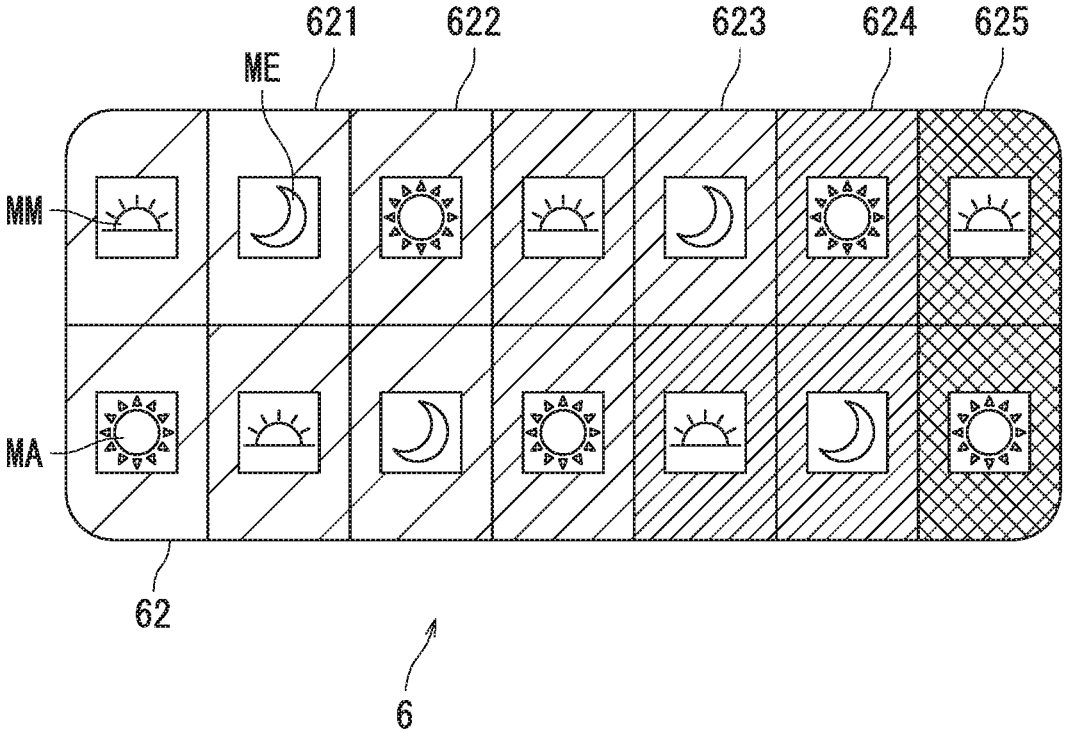
FIG. 3B is a diagram illustrating a reverse side of the medication package.

Next, the configuration of the controller 12 will be further described with reference to FIGS. 1 and 3A and 3B. FIG. 3A is a perspective view illustrating the package 6 of medication 63. FIG. 3Bis a diagram illustrating the reverse side of the package 6 of the medication 63.

As illustrated in FIG. 3A, the package 6 of the medication 63 includes an obverse film 61, a reverse film 62, and the medication 63. The medication 63 is in tablet form, for example.

The obverse film 61 is made of transparent resin and has space to house the medication 63. The reverse film 62 is made of resin and is substantially flat. The obverse film 61 is affixed to the reverse film 62 with adhesive, for example.

Because the aromatic components included in the respective inks Kc to Kk are different from each other according to the present embodiment, the scent of an image is determined by determining the color of the image. The first determining section 121 then determines densities of the color to indicate days of the week on which the medication 63 is to be taken.

The second determining section 122 determines the strength of the scent based on the period from when the scent is applied to the package 6 or the paper 8 to the date the medication 63 is to be taken. Specifically, the second determining section 122 increases the strength of the scent as the period becomes longer.

The applying section 123 applies the scent determined by the first determining section 121 to the package 6 of the medication 63 or the paper 8. That is, the applying section 123 applies the scent to the package 6 of the medication 63 or the paper 8 through a recording head 34 spraying the corresponding one of the inks Kc to Kk that includes the scent determined by the first determining section 121 on to the package 6 of the medication 63 or the paper 8. Specifically, the applying section 123 forms an image of a color corresponding to a scent determined by the first determining section 121 on the package 6 of the medication 63 or the paper 8.

Furthermore, the first determining section 121 determines a mark to indicate time of day at which the medication 63 is to be taken, based on an instruction from the user. For example, the first determining section 121 determines a morning mark MM indicating morning, an afternoon mark MA indicating afternoon, and an evening mark ME indicating evening from a plurality of selectable marks.

The forming section 124 forms color images each having a density determined by the first determining section 121 on the package 6 of the medication 63 or the paper 8. Each density of the color indicates a day of the week on which the medication 63 is to be taken.

The forming section 124 also forms an image of a mark M determined by the first determining section 121 on the package 6 of the medication 63 or the paper 8. Specifically, the forming section 124 forms the morning mark MM indicating morning, the afternoon mark MA indicating afternoon, and the evening mark ME indicating evening on the package 6 of the medication 63 or the paper 8.

As illustrated in FIG. 3B, the reverse film 62 includes a color image 621 in a density indicating Monday, a color image 622 in a density indicating Tuesday, a color image 623 in a density indicating Wednesday, a color image 624 in a density indicating Thursday, and a color image 625 in a density indicating Friday. According to the present embodiment, the densities of the color images 621 to 625 corresponding to the respective days of the week fulfill the following formula (1).

$$\text{Density of color image } \mathbf{621} < \text{density of color image } \mathbf{622} < \text{density of color image } \mathbf{623} < \text{density of color image } \mathbf{624} < \text{density of color image } \mathbf{625} \quad (1)$$

The color image 621 is formed on the reverse side in locations of three tablets, and the location on the reverse side of each tablet has the morning mark MM, the afternoon mark MA, or the evening mark ME formed thereon. The tablet corresponding to the morning mark MM is to be taken on a Monday morning. The tablet corresponding to the afternoon mark MA is to be taken on a Monday afternoon. The tablet corresponding to the evening mark ME is to be taken on a Monday evening.

Similarly to the color image 621, the color images 622 to 624 are also formed on the reverse side in locations of three tablets each, and the location on the reverse side of each of the tablets has the morning mark MM, the afternoon mark MA, or the evening mark ME formed thereon. Each of the tablets corresponding to the morning mark MM is to be taken on mornings from Tuesday to Thursday. Each of the tablets corresponding to the afternoon mark MA is to be taken on afternoons from Tuesday to Thursday. Each of the tablets corresponding to the evening mark ME is to be taken on evenings from Tuesday to Thursday.

The color image 625 is formed on the reverse side in locations of two tablets, and the location on the reverse side of each of the tablets has the morning mark MM or the afternoon mark MA formed thereon. The tablet corresponding to the morning mark MM is to be taken on a Friday morning. The tablet corresponding to the afternoon mark MA is to be taken on a Friday afternoon.

According to the present embodiment as described above with reference to FIGS. 1 to 3A and 3B, the forming section 124 forms the color images 621 to 625 indicating the days of the week on which the medication 63 is to be taken on the package 6 of the medication 63. Accordingly, the user can be prevented from taking the medication 63 on a wrong day.

The forming section 124 also forms images of the marks MM, MA, and ME indicating times of day on the package 6 of the medication 63. Accordingly, the user can be prevented from taking the medication 63 at a wrong time.

Furthermore, the first determining section 121 determines the marks MM, MA, and ME to be formed on the package 6 of the medication 63 based on an instruction from the user. Accordingly, the marks MM, MA, and ME desired by the user can be formed on the package 6 of the medication 63.

Figure 4:
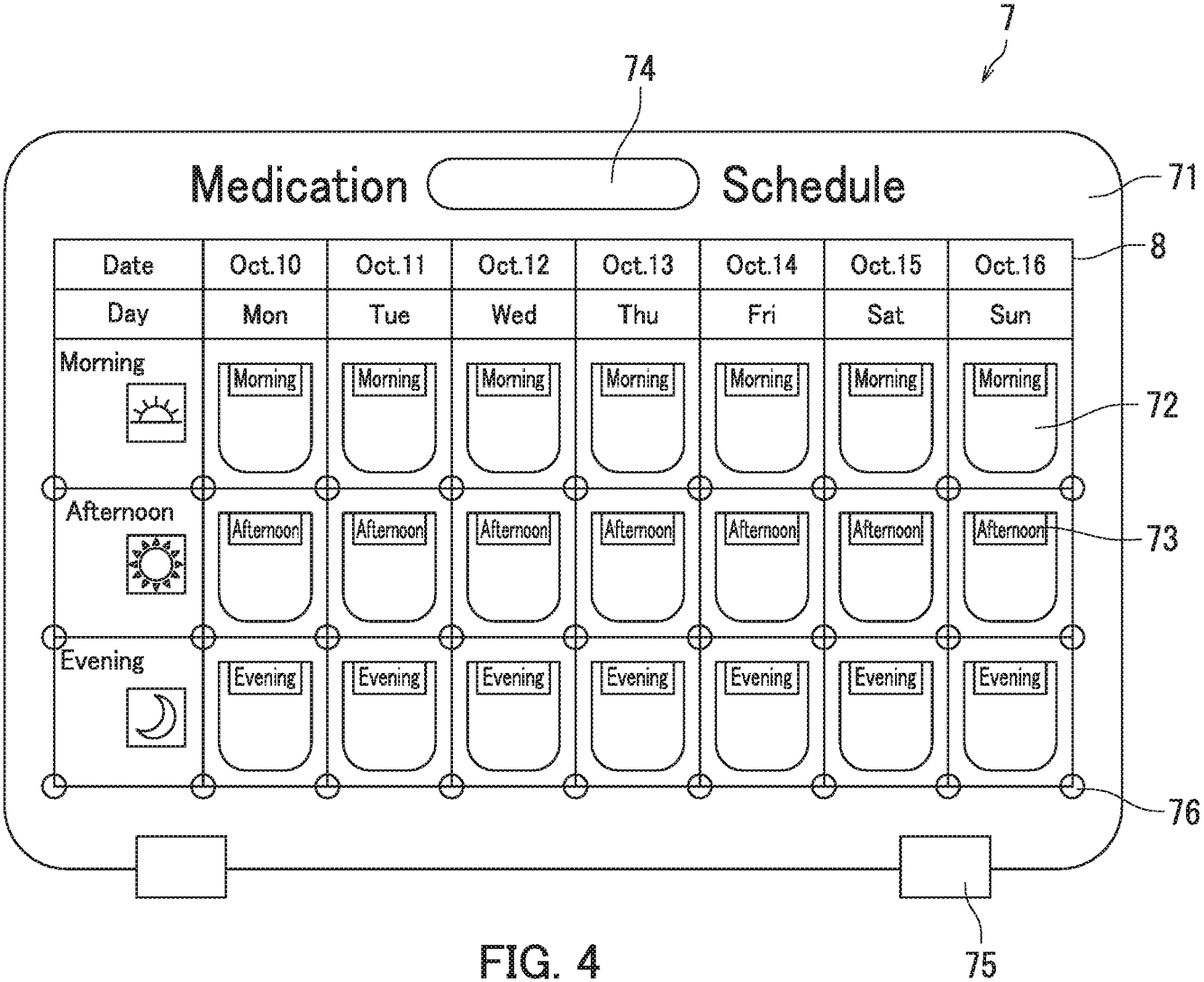
FIG. 4 is a front view illustrating a medication housing board.
Figure 5:
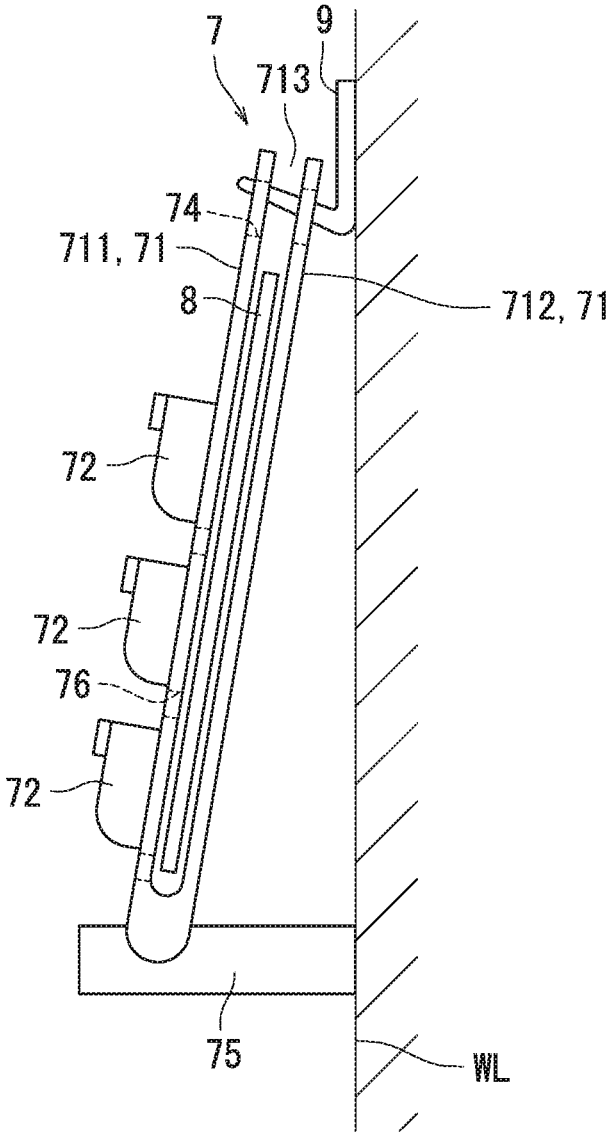
FIG. 5 is a side view illustrating the medication housing board.
Figure 6:
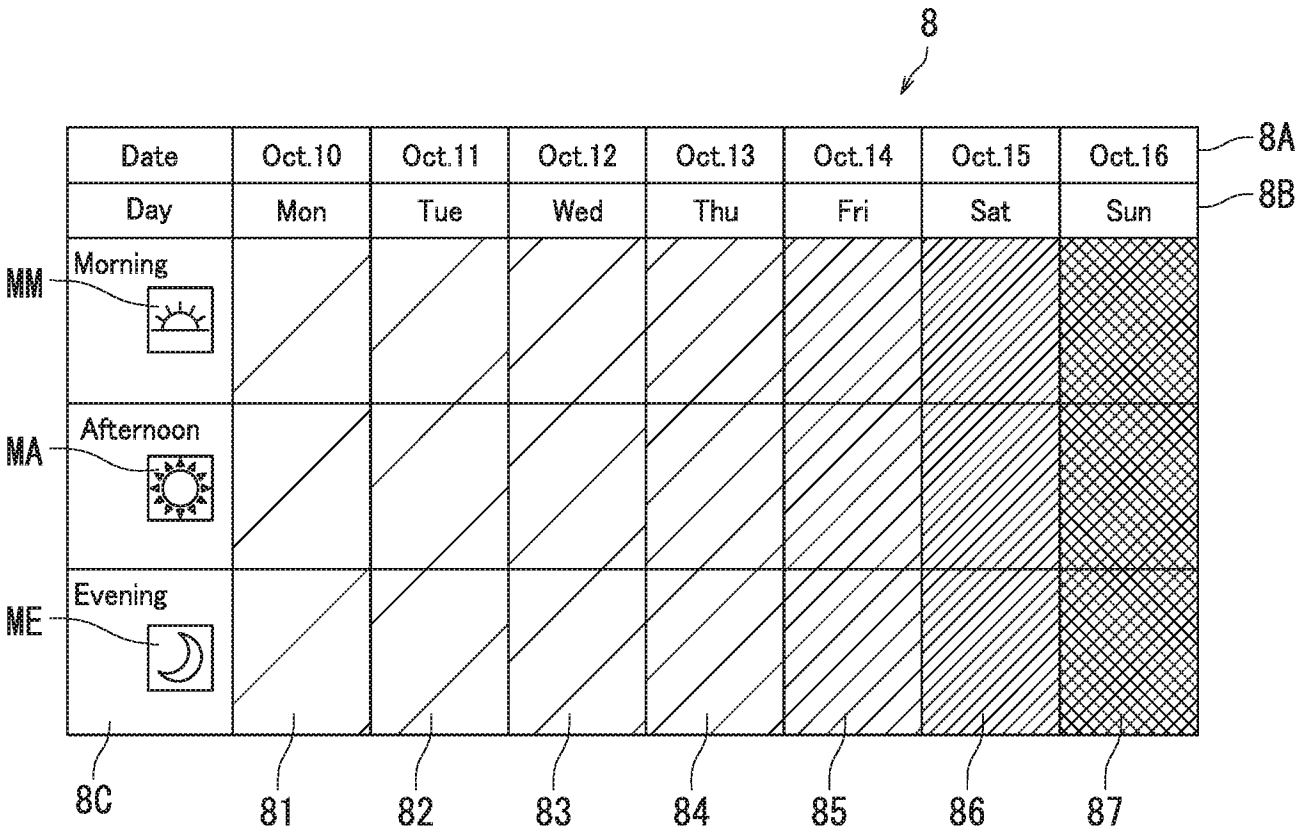
FIG. 6 is a diagram illustrating paper with a medication calendar printed thereon.

Next, the configuration of the controller 12 will be further described with reference to FIGS. 1 to 6. FIG. 4 is a front view illustrating a medication housing board 7. FIG. 5 is a side view illustrating the medication housing board 7. FIG. 6 is a diagram illustrating the paper 8 with a medication calendar printed thereon.

As illustrated in FIGS. 4 and 5, the medication housing board 7 includes a main body 71, housing containers 72, and legs 75.

The main body 71 houses the paper 8. The main body 71 is also configured so that each housing container 72 is freely attachable and detachable. The main body 71 is made of transparent resin, for example. As illustrated in FIG. 5, the main body 71 also includes an obverse plate 711, a reverse plate 712, an opening 713, and a hanging hole 74.

As illustrated in FIG. 5, the obverse plate 711 is a plate-shaped member which covers the obverse side of the paper 8. The reverse plate 712 is a plate-shaped member which covers the reverse side of the paper 8. The bottom edge and both width direction edges of the obverse plate 711 are respectively connected to the bottom edge and both width direction edges of the reverse plate 712. The width direction indicates a left-right direction in FIG. 4. The main body 71 is in a thin box shape with an opening in an upper portion thereof.

The opening 713 is located in the upper portion of the main body 71. The paper 8 is inserted between the obverse plate 711 and the reverse plate 712 from the top of the main body 71 through the opening 713. The paper 8 is held between the obverse plate 711 and the reverse plate 712.

The obverse plate 711 includes a plurality of air holes 76. The air holes 76 release the scent applied to the paper 8 into the atmosphere. The air holes 76 are each substantially circular and are arranged in a lattice pattern on the obverse plate 711.

The hanging hole 74 is located in the upper portion of the main body 71, approximately in the middle of the main body 71 with respect to the width direction. Specifically, as illustrated in FIG. 5, a hook 9 is inserted into the hanging hole 74 when the medication housing board 7 is suspended from the hook 9. The hook 9 is fixed to a wall WL.

Each housing container 72 houses the medication 63. For example, a housing container 72 is open at the top. The housing container 72 is attached to the main body 71. Furthermore, the housing container 72 includes a display section 73.

The display section 73 displays the time of day in which the medication 63 is to be taken. Specifically, the word "morning", "afternoon", or "evening" is displayed in the display section 73. The medication 63 to be taken in the morning is housed in a housing container 72 on which "morning" is displayed in the display section 73. The medication 63 to be taken in the afternoon is housed in a housing container 72 on which "afternoon" is displayed in the display section 73. The medication 63 to be taken in the evening is housed in a housing container 72 on which "evening" is displayed in the display section 73.

The legs 75 are located at the bottom of the main body 71, on both ends of the main body 71 in the width direction. Each leg 75 has a substantially rectangular shape. As illustrated in FIG. 5, the main body 71 is inclined so that the bottom of the main body 71 separates from the surface of the wall WL when the medication housing board 7 is suspended from the hook 9.

As such, the medication 63 housed in the housing containers 72 can be prevented from falling out since the main body 71 is inclined such that the bottom of the main body 71 separates from the surface of the wall WL. Note that the tablets of the medication 63 in the package 6 are separated from one another by the user and separately housed in the appropriate housing containers 72 according to the days of the week, morning, afternoon, and evening.

As illustrated in FIG. 6, the paper 8 includes a date area 8A, a day of the week area 8B, and a time of day area 8C. Character strings each exhibiting a date are printed in the date area 8A. Character strings each exhibiting a day of the week are printed in the day of the week area 8B.

The forming section 124 forms images of marks determined by the first determining section 121 on the paper 8 on which the medication calendar is printed. Specifically, the forming section 124 forms the images of the marks in the time of day area 8C. The marks are the morning mark MM indicating morning, the afternoon mark MA indicating afternoon, or the evening mark ME indicating evening.

The forming section 124 forms color images in densities determined by the first determining section 121 on the paper 8. The density of each color image indicates a day of the week on which the medication 63 is to be taken.

The applying section 123 applies a scent determined by the first determining section 121 to the paper 8. That is, the applying section 123 applies the scent to the paper 8 through a recording head 34 spraying one of the inks Kc to Kk that includes the scent determined by the first determining section 121 on to the paper 8. Specifically, the applying section 123 forms images in a color corresponding to a scent determined by the first determining section 121 on the paper 8. The "medication calendar" exhibits dates on which the medication 63 is to be taken.

As illustrated in FIG. 6, the paper 8 includes a color image 81 in a density indicating Monday, a color image 82 in a density indicating Tuesday, a color image 83 in a density indicating Wednesday, a color image 84 in a density indicating Thursday, a color image 85 in a density indicating Friday, a color image 86 in a density indicating Saturday, and a color image 87 in a density indicating Sunday. According to the present embodiment, the densities of the color images 81 to 87 exhibiting the respective days of the week fulfill the following formula (2).

$$\text{Density of color image } \mathbf{81} < \text{density of color image } \mathbf{82} < \text{density of color image } \mathbf{83} < \text{density of color image } \mathbf{84} < \text{density of color image } \mathbf{85} < \text{density of color image } \mathbf{86} < \text{density of color image } \mathbf{87} \quad (2)$$

The color image 81 is formed in a location in which the medication 63 to be taken on Monday is housed, among the housing containers 72. Similarly, the color images 82 to 87 are respectively formed in locations in which the medication 63 to be taken from Tuesday to Sunday is housed, among the housing containers 72 (refer to FIG. 4).

According to the present embodiment as described above with reference to FIGS. 1 to 6, the applying section 123 applies the scent indicating the person taking the medication 63 to the paper 8 on which the medication calendar is printed. Accordingly, the user can be prevented from mistaking the medication calendar of another person for the medication calendar of the user.

The first determining section 121 determines the strength of a scent with respect to a period from when the scent is applied to the date on which the medication 63 is to be taken. Specifically, the strength of the scent is increased as the period from when the scent is applied to the date on which the medication 63 is to be taken lengthens. Also, the applying section 123 applies the scent with the determined strength to a location of the paper 8 exhibiting the date on which the medication 63 is to be taken. Accordingly, the user can be prevented from mistaking the paper 8 on which the medication calendar of another person is printed for the paper 8 on which the medication calendar of the user is printed, even as time passes.

Furthermore, the forming section 124 forms images in densities indicating days of the week on which the medication 63 is to be taken on the paper 8 on which the medication calendar is printed. Therefore, the user can be prevented from mistaking the day of the week on which the medication 63 is to be taken by associating the densities of the images formed on the package 6 of the medication 63 with the densities of the images formed on the paper 8 on which the medication calendar is printed.

Figure 7:
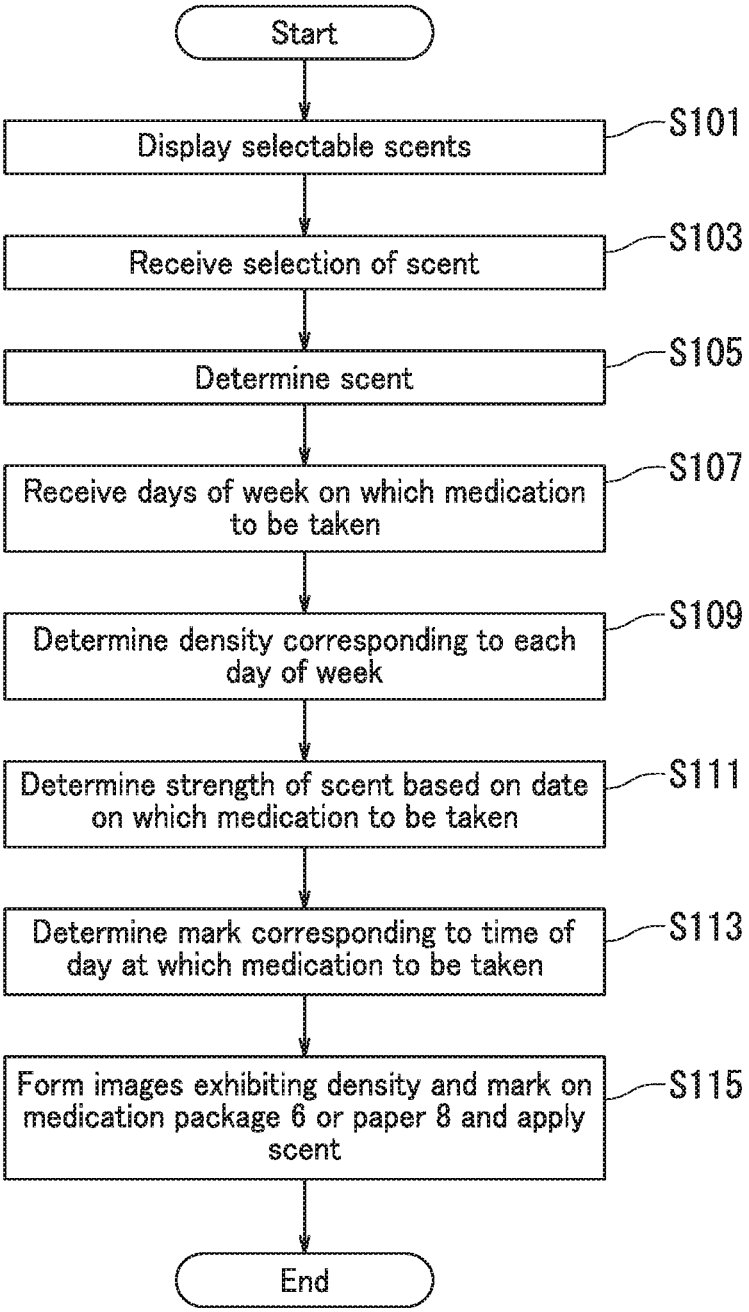
FIG. 7 is a flowchart illustrating a process of the controller.

Next, a process of the controller 12 will be described with reference to FIGS. 1 to 7. FIG. 7 is a flowchart illustrating the process of the controller 12.

First, in Step S101 as illustrated in FIG. 7, the first determining section 121 displays a plurality of selectable scents on the touch panel 131.

Next, in Step S103, the first determining section 121 receives a selection of a scent from the user (a person taking the medication 63, for example) through the touch panel 131.

Then, in Step S105, the first determining section 121 determines the scent indicating the person taking the medication 63.

Next, in Step S107, the first determining section 121 receives days of the week on which the medication 63 is to be taken from the user through the touch panel 131.

Then, in Step S109, the first determining section 121 determines a density corresponding to each day of the week on which the medication 63 is to be taken.

Next, in Step S111, the second determining section 122 determines the strength of the scent based on the period from when the scent is applied to the package 6 of the medication 63 or the paper 8 to the date on which the medication 63 is to be taken.

Next, in Step S113, the first determining section 121 determines a mark indicating a time of day at which the medication 63 is to be taken.

Then, in Step S115, the forming section 124 forms the images exhibiting the densities and the mark on the package 6 of the medication 63 or the paper 8, and the applying section 123 applies the scent indicating the person taking the medication 63 on the package 6 of the medication 63 or the paper 8. Thereafter, the process ends.

As described above with reference to FIGS. 1 to 7, the user can be prevented from mistaking the medication 63 of another person for the medication 63 of the user because the scent indicating the person taking the medication 63 is applied to the package 6 of the medication 63.

An embodiment of the present disclosure is described above with reference to the drawings. However, the present disclosure is not limited to the above embodiment and may be practiced in various forms without deviating from the essence thereof (for example, as described below in sections (1) to (3)). The drawings schematically illustrate elements of configuration in order to facilitate understanding, and properties of elements of configuration illustrated in the drawings, such as thickness, length, and number thereof, may differ from actual properties thereof in order to facilitate preparation of the drawings. Furthermore, properties of elements of configuration described in the above embodiment, such as shapes and dimensions, are merely examples and are not intended as specific limitations. The elements may be altered without substantially deviating from the configuration of the present disclosure.

(1) According to the present embodiment as described with reference to FIG. 1, the image forming apparatus is the inkjet recording device 1. However, the present disclosure is not limited hereto. The image forming apparatus need only form an image on a recording medium. For example, the image forming apparatus may also form an image on a recording medium electrographically. In such a case, an aromatic component is added to toner.

(2) According to the present embodiment as described with reference to FIG. 1, aromatic components are added to the inks Kc to Km in the inkjet recording device 1. However, the present disclosure is not limited hereto. The aromatic components need only be applied to the package of medication. The aromatic components may be applied to the package of medication separately from the inks. For example, the inkjet recording device 1 may include a head that applies an aromatic component to the package of medication separately from the recording heads 34. In this case, the scent can be applied to the package of medication separately from the image.

(3) According the present disclosure as described with reference to FIGS. 1 to 3B, the first determining section 121 determines densities indicating days of the week on which the medication is to be taken. However, the present disclosure is not limited hereto. The first determining section 121 need only determine colors indicating days of the week or dates on which the medication is to be taken. For example, the first determining section 121 may determine chromas indicating dates on which the medication is to be taken.

What is claimed is:

1. An image forming apparatus which is a color inkjet recording device that uses inks containing respective aromatic components added thereto, the aromatic components differing from each other, the image forming apparatus comprising:

a first determining section configured to determine, among the aromatic components, an aromatic component indicating a person taking medication; and an applying section configured to apply the aromatic component determined by the first determining section to a package of the medication by spraying an ink containing the aromatic component on to the package of the medication to form an image, wherein the applying section adjusts a strength of a scent of the aromatic component by adjusting a density of the image to be formed on the package of the medication.

2. The image forming apparatus according to claim 1, wherein the applying section applies the aromatic component determined by the first determining section to paper on which a medication calendar is printed, and the medication calendar exhibits either or both of dates on which the medication is to be taken and days of the week on which the medication is to be taken.

3. The image forming apparatus according to claim 2, further comprising:

a second determining section configured to determine the strength of the scent of the aromatic component based on a period from when the aromatic component is applied to the paper to a date on which the medication is to be taken, wherein the applying section applies the aromatic component according to the strength of the scent determined by the second determining section to a location indicating the dates on which the medication is to be taken on the medication calendar.

* * * * *